US008006510B2

(12) United States Patent
Miyamoto et al.

(10) Patent No.: US 8,006,510 B2
(45) Date of Patent: Aug. 30, 2011

(54) INDOOR EQUIPMENT OF AIR CONDITIONER

(75) Inventors: Teruo Miyamoto, Tokyo (JP); Mitsuhiro Shirota, Tokyo (JP); Isao Okano, Tokyo (JP); Masahiro Motooka, Tokyo (JP); Tetsuya Tazawa, Tokyo (JP); Shinsuke Nakahata, Tokyo (JP); Yohei Kawahara, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 706 days.

(21) Appl. No.: 12/067,276

(22) PCT Filed: Oct. 30, 2006

(86) PCT No.: PCT/JP2006/321633

§ 371 (c)(1),
(2), (4) Date: Mar. 18, 2008

(87) PCT Pub. No.: WO2007/052593

PCT Pub. Date: May 10, 2007

(65) Prior Publication Data

US 2010/0058793 A1 Mar. 11, 2010

(30) Foreign Application Priority Data

Oct. 31, 2005 (JP) ..... 2005-315554

(51) Int. Cl.
*F25D 21/14* (2006.01)

(52) U.S. Cl. ..... 62/285; 62/288; 62/291

(58) Field of Classification Search ..... 62/262, 62/272, 285, 291
See application file for complete search history.

(56) References Cited

U.S. PATENT DOCUMENTS 6,240,740 B1 * 6/2001 Endo et al. ..... 62/285

FOREIGN PATENT DOCUMENTS

| | | |
|---|---|---|
| GB | 2 056 051 (A) | 3/1981 |
| JP | 52-087896 U | 6/1977 |
| JP | 56-014611 (A) | 2/1981 |

(Continued)

OTHER PUBLICATIONS

Form PCT/ISA/210 (International Search Report) dated Dec. 5, 2006.

*Primary Examiner* — Frantz F Jules
*Assistant Examiner* — Emmanuel Duke
(74) *Attorney, Agent, or Firm* — Buchanan Ingersoll & Rooney PC

(57) ABSTRACT

In an indoor equipment of an air conditioner in which a heat exchanger, a blower, and a drain pan receiving a drain water having been condensed at mentioned heat exchanger below the heat exchanger are contained in an internal part of the indoor equipment housing including an air inlet and an air outlet; and a back portion of the drain pan is faced to an air flow path communicating with mentioned air outlet, and a stabilizer is disposed at an end portion on the upstream side of the air flow path of this drain pan, the drain pan 4 is integrally formed of a drain pan body 41 and a stabilizer portion 42 by injection molding; and a concave portion 40 is formed on the air flow path side in the vicinity of the boundary between the drain pan body and the stabilizer portion.

4 Claims, 7 Drawing Sheets

FOREIGN PATENT DOCUMENTS

| | | | |
|---|---|---|---|
| JP | 56-085210 | U | 7/1981 |
| JP | 61-015420 | U | 1/1986 |
| JP | 6-011148 | (A) | 1/1994 |
| JP | 9-004869 | (A) | 1/1997 |
| JP | 2000-234757 | * | 8/2000 |
| JP | 2000-304299 | * | 11/2000 |
| JP | 2001-214148 | * | 8/2001 |
| JP | 2002-139231 | (A) | 5/2002 |

* cited by examiner

INDOOR EQUIPMENT OF AIR CONDITIONER

TECHNICAL FIELD

The present invention relates to an indoor equipment of an air conditioner that is mounted onto a wall surface in a room to be used.

BACKGROUND ART

As a conventional indoor equipment of an air conditioner, there is one known structure in which a drain pan acting to collect a dew condensation water that is generated at a heat exchanger, and a stabilizer (provided on the closest portion with respect to a cross-flow fan) that is provided on the upstream side of an air flow path of the drain pan are constructed to be separate parts, and in which the stabilizer is fitted to an end portion of the drain pan to be secured (for example, refer to Patent Document 1).

Patent Document 1: Japanese Patent No. 3107504 (on page 1, FIG. 1)

DISCLOSURE OF INVENTION

Problems to be Solved by the Invention

In the conventional indoor equipment of the air conditioner of the above-mentioned construction, since the stabilizer is structured to be separate from the drain pan body, a problem exists in that the number of parts is increased, and forming process costs as well as assembly costs come to be high. Another problem exists in that an air of high humidity enters from a fit portion between the drain pan and the stabilizer into the space that is formed between the drain pan and the stabilizer, and dew condensation water is collected in the internal part. Moreover, a further problem exists in that when the conventional indoor equipment is operated in the state of small amount of blowout wind, an outside air flows back along an air flow path side at the drain pan bottom, and thus the adhesion of dew to a fan is likely to occur.

The present invention was made to solve the above-mentioned problems of the prior arts, and has an object of obtaining an indoor equipment of an air conditioner that can be constructed of a small number of parts, in which the accumulation of dew condensation water and the back-flow of an outside air are prevented, of which quality is improved and of which cost is low.

Means of Solution to the Problems

The present invention is an indoor equipment of an air conditioner in which a heat exchanger, a blower, and a drain pan receiving a drain water having been condensed at the mentioned heat exchanger below the mentioned heat exchanger are contained in an internal part of an indoor equipment housing that includes an air inlet and an air outlet; and a back portion of the mentioned drain pan is faced to an air flow path communicating to the mentioned air outlet, and a stabilizer is disposed at an end portion on the upstream side of the air flow path of the mentioned drain pan; the indoor equipment of an air conditioner comprising an integrally molded drain pan formed of a drain pan body and a stabilizer portion by injection molding; and in which a concave portion is formed on the air flow path side in the vicinity of the boundary between the mentioned drain pan body and the mentioned stabilizer portion.

EFFECT OF THE INVENTION

In this invention, due to that the stabilizer and the drain pan having been separate parts are constructed into an integral structure, the number of parts can be decreased, and machining costs and assembly costs can be reduced. Furthermore, since there is no space to be formed by the drain pan and the stabilizer, dew condensation water is not collected. In addition, since a concave portion is provided on the air flow path side in the vicinity of the boundary between the drain pan body and the stabilizer portion, a blowout wind is likely to flow along the wall surface at the backside of the drain pan body. As a result, an outside air of high temperature and high humidity is less likely to flow back, and thus the defect of dew splash due to that the dew is adhered to the fan can be suppressed. Moreover, due to the provision of the above-mentioned concave portion, a mold release resistance at the time of molding can be ensured, and thus a product can be prevented from being taken with the die, resulting in an improved productivity.

BEST MODE FOR CARRYING OUT THE INVENTION

Embodiment 1

Figure 1:
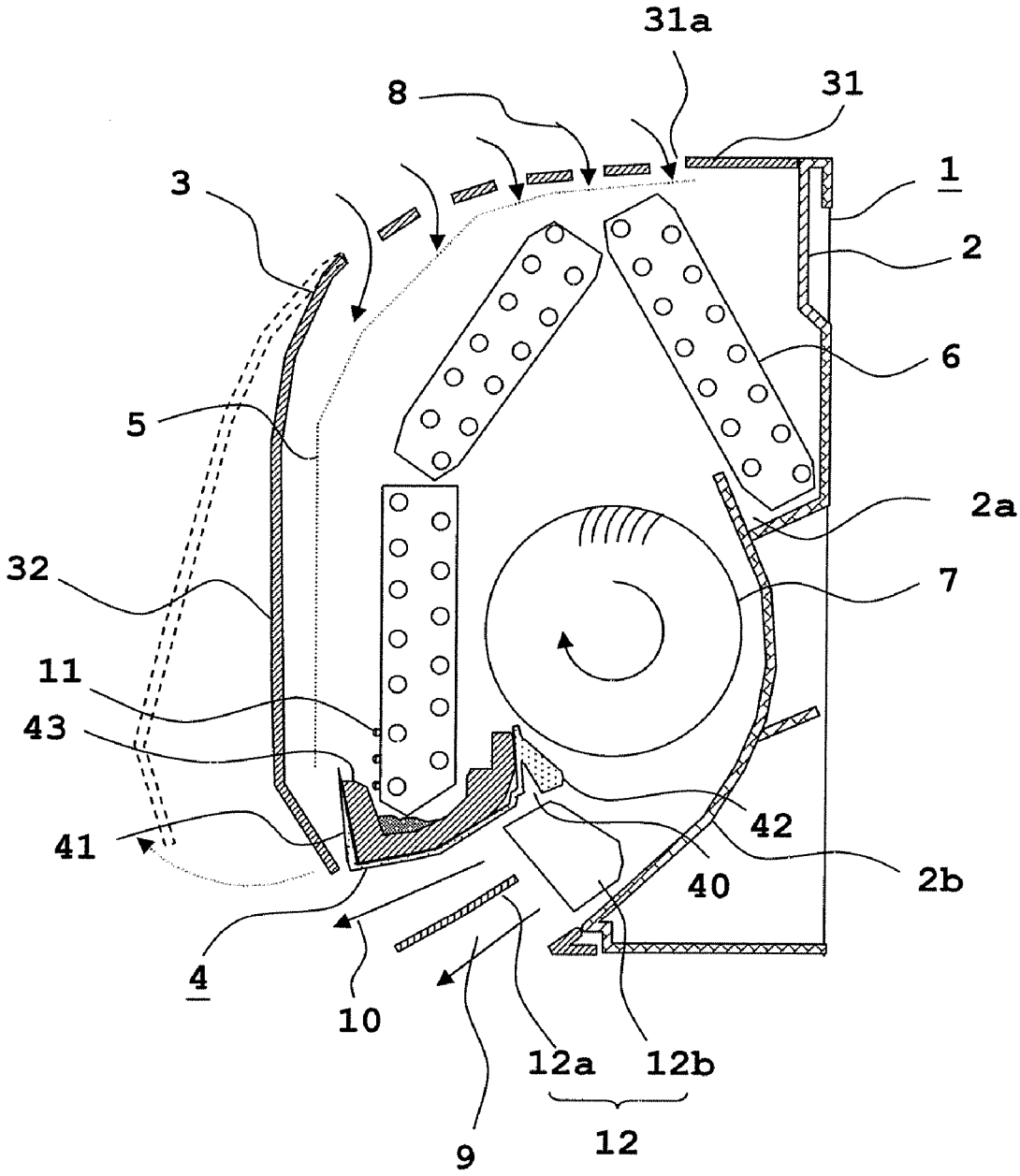
FIG. 1 is a sectional view schematically illustrating a construction of an essential part of an indoor equipment of an air conditioner according to a first embodiment of the present invention.
Figure 2:
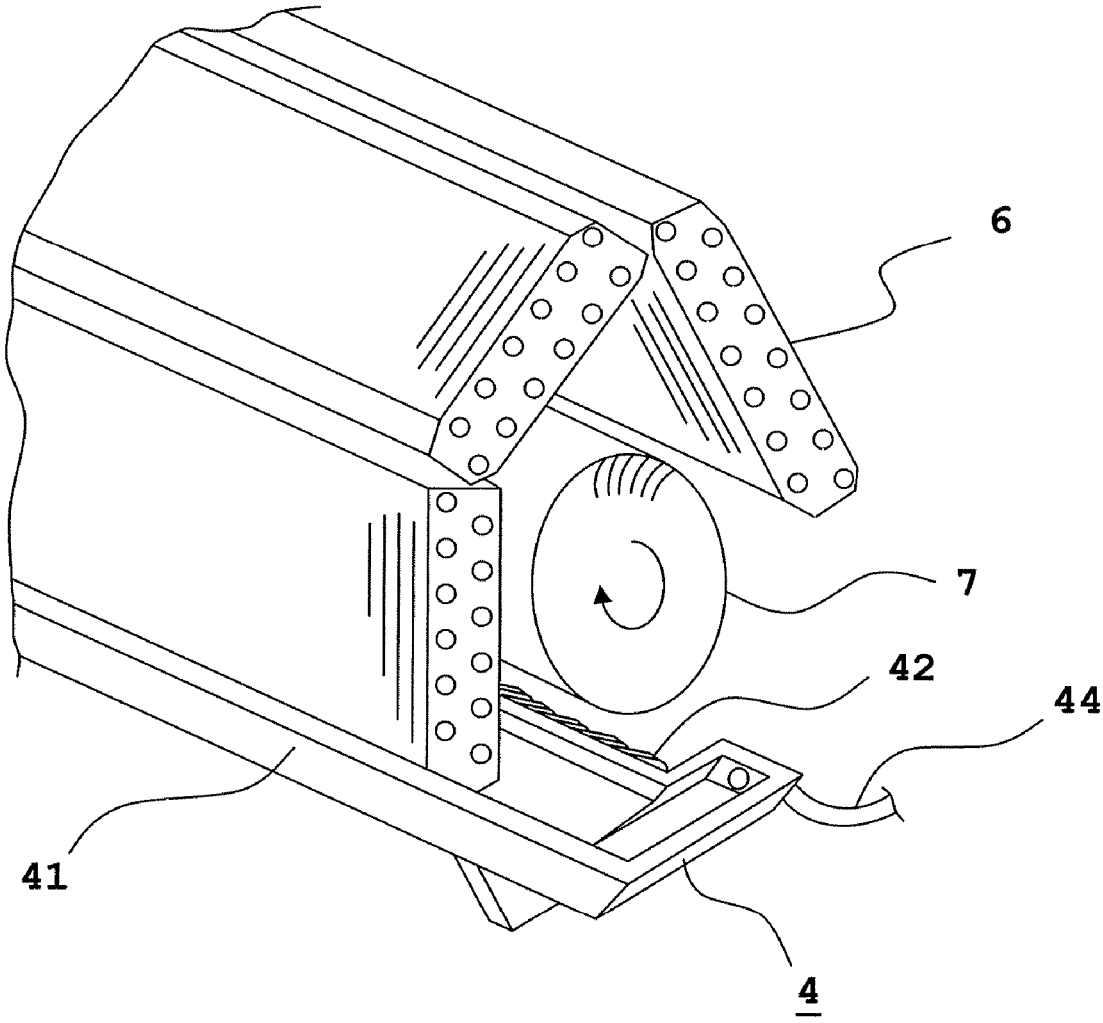
FIG. 2 is a perspective view picking up and illustrating a heat exchanger, a blower and a drain pan portion illustrated in FIG. 1.
Figure 3:
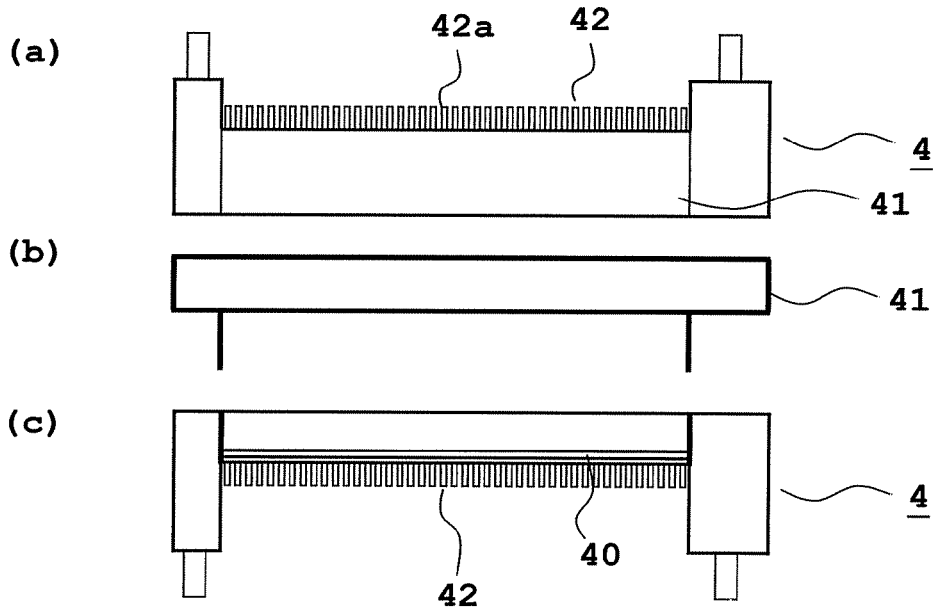
FIG. 3 are views each illustrating the shape of a drain pan integrated with a stabilizer illustrated in FIG. 1, and in which FIG. 3(*a*) is a top view, FIG. 3(*b*) is an elevation view, and FIG. 3(*c*) is a bottom view.
Figure 4:
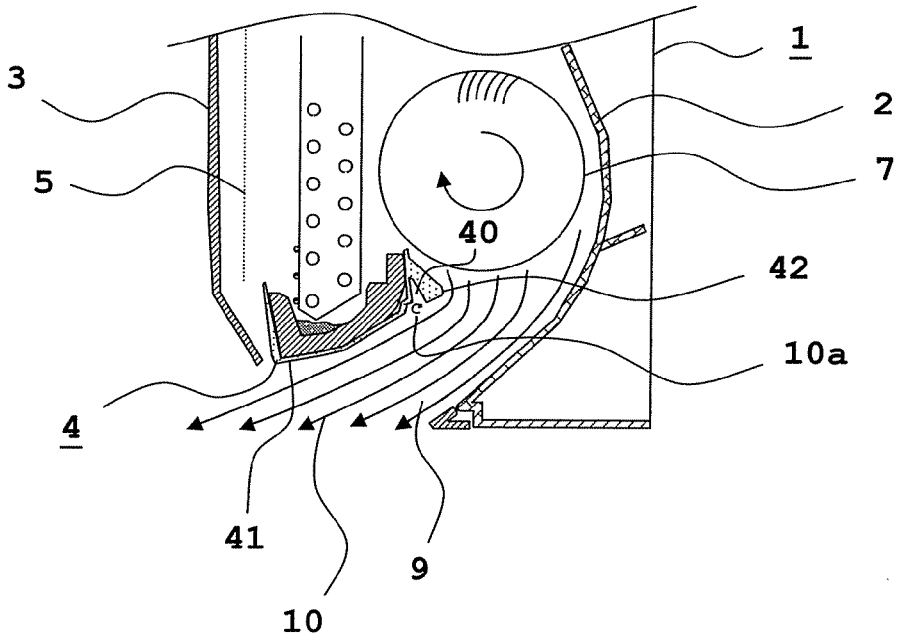
FIG. 4 is a partially sectional view explaining operations in the vicinity of an air outlet of FIG. 1.
Figure 5:
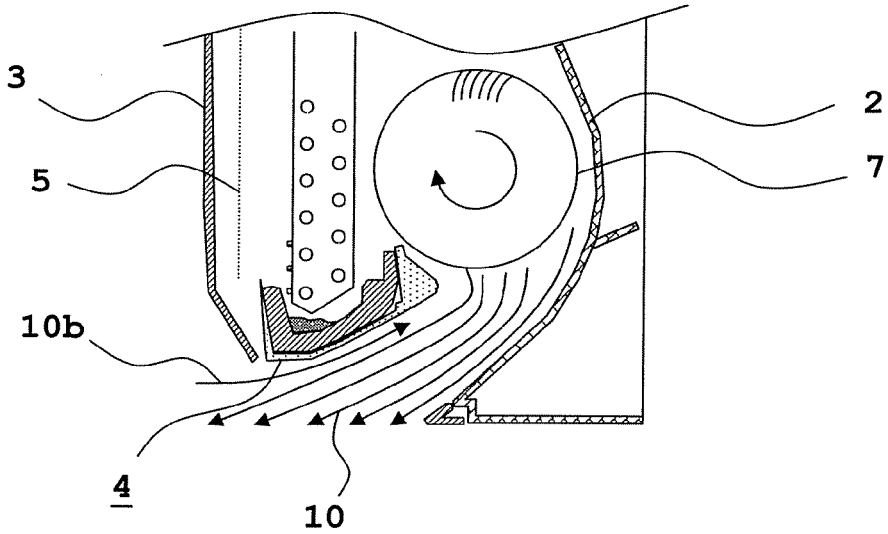
FIG. 5 is a reference view corresponding to FIG. 4 for explaining the operations in the vicinity of the air outlet in the case where there is no concave portion on the air flow path side in the vicinity of the boundary between the drain pan body and the stabilizer portion.
Figure 6:
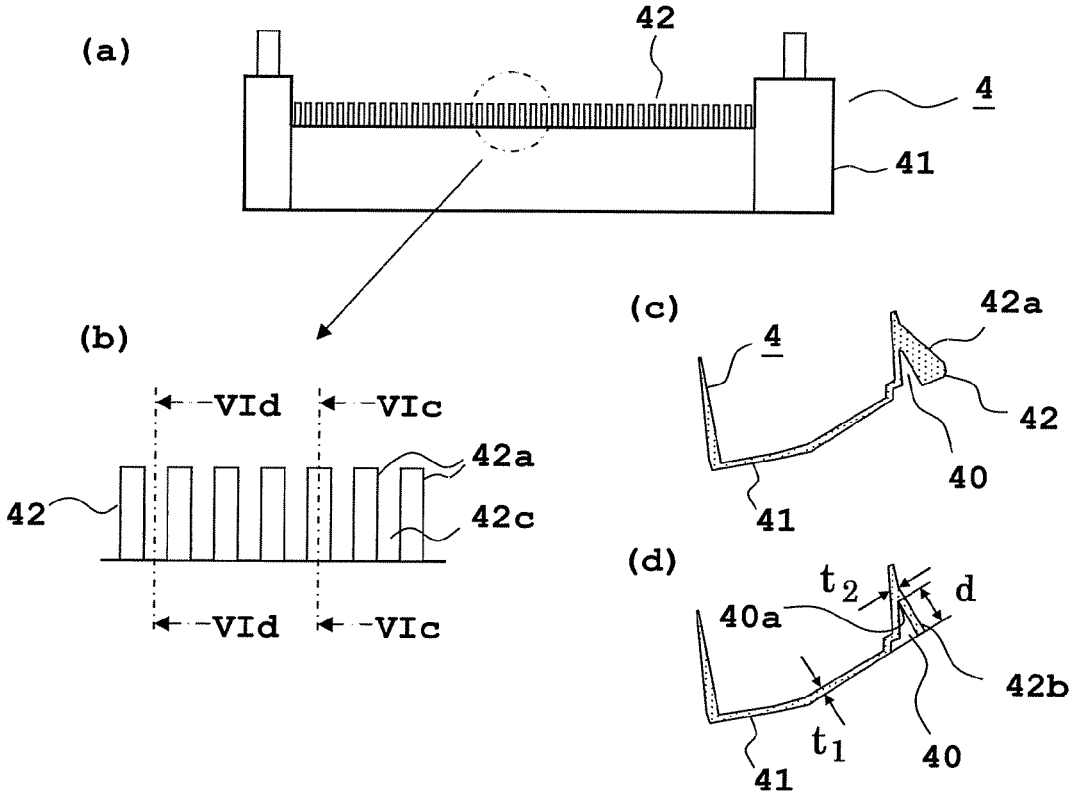
FIG. 6 are views each illustrating in detail a structure of the drain pan integrated with a stabilizer illustrated in FIG. 3, and in which FIG. 6(*a*) is a top view, FIG. 6(*b*) is an enlarged view of a circled portion of one-dot chain line of FIG. 6(*a*), FIG. 6(*c*) is a sectional view taken along the line VIc-VIc of FIG. 6(*b*) indicated by the arrows, and FIG. 6(*d*) is a sectional view taken along the line VId-VId indicated by the arrows.

FIGS. 1 to 6 illustrate an indoor equipment of an air conditioner according to a first preferred embodiment of the present invention. FIG. 1 is a sectional view schematically illustrating a principal portion construction; FIG. 2 is a perspective view picking up and illustrating a heat exchanger, a blower and a drain pan portion illustrated in FIG. 1; FIG. 3 are views each illustrating the shape of a drain pan integrated with a stabilizer illustrated in FIG. 1, and in which FIG. 3(*a*) is a top view, FIG. 3(*b*) is an elevation view, and FIG. 3(*c*) is a bottom view; FIG. 4 is a partially sectional view explaining operations in the vicinity of an air outlet of FIG. 1; FIG. 5 is a reference view corresponding to FIG. 4 for explaining the operations in the vicinity of the air outlet in the case where there is no concave portion on the air flow path side in the vicinity of the boundary between the drain pan body and the stabilizer portion; and FIG. 6 are views each illustrating in detail a structure of the drain pan integrated with a stabilizer illustrated in FIG. 3, and in which FIG. 6(*a*) is a top view, FIG. 6(*b*) is an enlarged view of a circled portion of one-dot chain line of FIG. 6(*a*), FIG. 6(*c*) is a sectional view on arrow taken along the line VIc-VIc of FIG. 6(*b*), and FIG. 6(*d*) is a sectional view on arrow taken along the line VId-VId of FIG. 6(*b*). Incidentally, throughout the drawings, the same reference numerals indicate the same or like parts.

In the drawings, an indoor equipment housing 1 includes a back housing 2 and a front housing 3. The front housing 3 includes a panel 31 provided with an air inlet 31*a* in a top panel, and a grill 32 that can be opened and closed. A rear drain pan 2*a* is provided at the vertically central portion of the back housing 2, and a rear guider 2*b* is formed from this rear drain pan 2*a* toward the lower end portion. In the internal part of the indoor equipment housing 1, there are contained a heat exchanger 6, a blower 7 formed of a cross-flow fan, a drain pan 4 that is integrally formed with a stabilizer, and a dust-removing filter 5. Furthermore, the lower end portion of the mentioned rear guider 2*b* and the back portion of the drain pan 4 form an air outlet 9, and there is disposed in this air outlet 9 wind direction control means 12 that is formed of a vertical wind direction flap 12*a* and a lateral wind direction vane 12*b* for controlling the wind direction.

The mentioned drain pan 4 integrated with a stabilizer, as illustrated in detail in FIGS. 2, 3 and 6, is an integrally molded structure of a drain pan body 41 and a stabilizer portion 42 by, e.g., injection molding; and a concave portion 40 is formed on the air flow path side in the vicinity of the boundary between the drain pan body 41 and the stabilizer portion 42. The mentioned stabilizer portion 42, as illustrated in FIG. 6, is formed of multiple tongue-like fin members 42*a* that are provided to protrude from the end portion on the inner side of the air outlet 9 of the drain pan body 41 into the interior, and that are proximate to an outer circumferential surface of the blower 7 to be opposed thereto, and a skirt member 42*b* providing a connection in a front-back direction on paper surface of FIG. 6(*d*) between these fin members 42*a* on the side opposite to the concave portion 40. Further, a space portion 42*c* formed between the fin members 42*a*. Incidentally, an insulating member 43 is provided on the inside of the top of the drain pan body 41 in such a configuration and assembly structure as being fit in close contact. Furthermore, condensed water that is collected in the drain pan 4 is discharged out of the room through a drain hose 44 as in the conventional apparatus. The other constructions are the same as in the conventional apparatus, so that further descriptions thereof are omitted.

Now, operations of the first embodiment constructed as mentioned above are described. In cooling or dehumidifying operation, by the rotation of the blower 7, an outside air is sucked from the air inlet 31*a* of the panel 31, and an air flow 8 having been sucked passes the heat exchanger 6 to be cooled and dehumidified. The air flow having been cooled and dehumidified passes an internal part of the blower 7, and is discharged into the room as a blowout air flow 10. At this time, the wind direction of the blowout air flow 10 is controlled to in vertical and lateral directions by means of the vertical wind direction flap 12*a* and the lateral wind direction vane 12*b*. In the heat exchanger at low temperature, due to that a warm and wet suction air flow 8 passes therethrough, drain water 11 is generated. The drain water 11 having been generated follows the surface of the heat exchanger 6, is collected on the insulating member 43 in the drain pan 4, and discharged out of the room through the drain hose 44.

Now, the flow of a blowout wind is described. In the vicinity of the air outlet 9, as illustrated in FIG. 4, the concave portion 40 is formed on the air flow path side in the vicinity of the boundary between the backside portion of the drain pan body 41 and the stabilizer portion 42. When the blowout wind 10 flows by the rotation of the blower 7, a whirl 10*a* is generated in the mentioned concave portion 40. By Coanda effect with this whirl 10*a*, the flow of the blowout wind 10 is sucked onto the wall surface of the drain pan 4, and flows along the backside of the drain pan 4. On the assumption that there is no concave portion 40, as illustrated in the reference view of FIG. 5, the flow of the blowout wind 10 is likely to be separated from the back wall of the drain pan 4. Particularly when the blower 7 is rotated at low speed, an outside air at high temperature and of high humidity will be sucked, thereby a back-flow 10*b* is likely to be generated. As a result, dew is adhered to the fan to contribute easily to the defect of splash of dew. Incidentally, in FIGS. 4 and 5, the illustration of the wind direction control means 12 is omitted.

As described above, according to this first embodiment, due to that a stabilizer having conventionally been a separate part is integrated with a drain pan body, the number of parts can be decreased, and a machining cost and an assembly cost can be reduced. Furthermore, since there is no space formed by the drain pan and the stabilizer, no dew condensation water is collected. Moreover, due to that the concave portion 40 is provided on the air flow path side in the vicinity of the boundary between the drain pan body 41 and the stabilizer portion 42, the blowout wind is likely to flow along the wall surface on the backside of the drain pan body 41, so that an outside air at high temperature and of high humidity is hardly sucked, thus enabling to suppress the defect of the splash of dew due to that dew is adhered to the fan.

Embodiment 2

Figure 7:
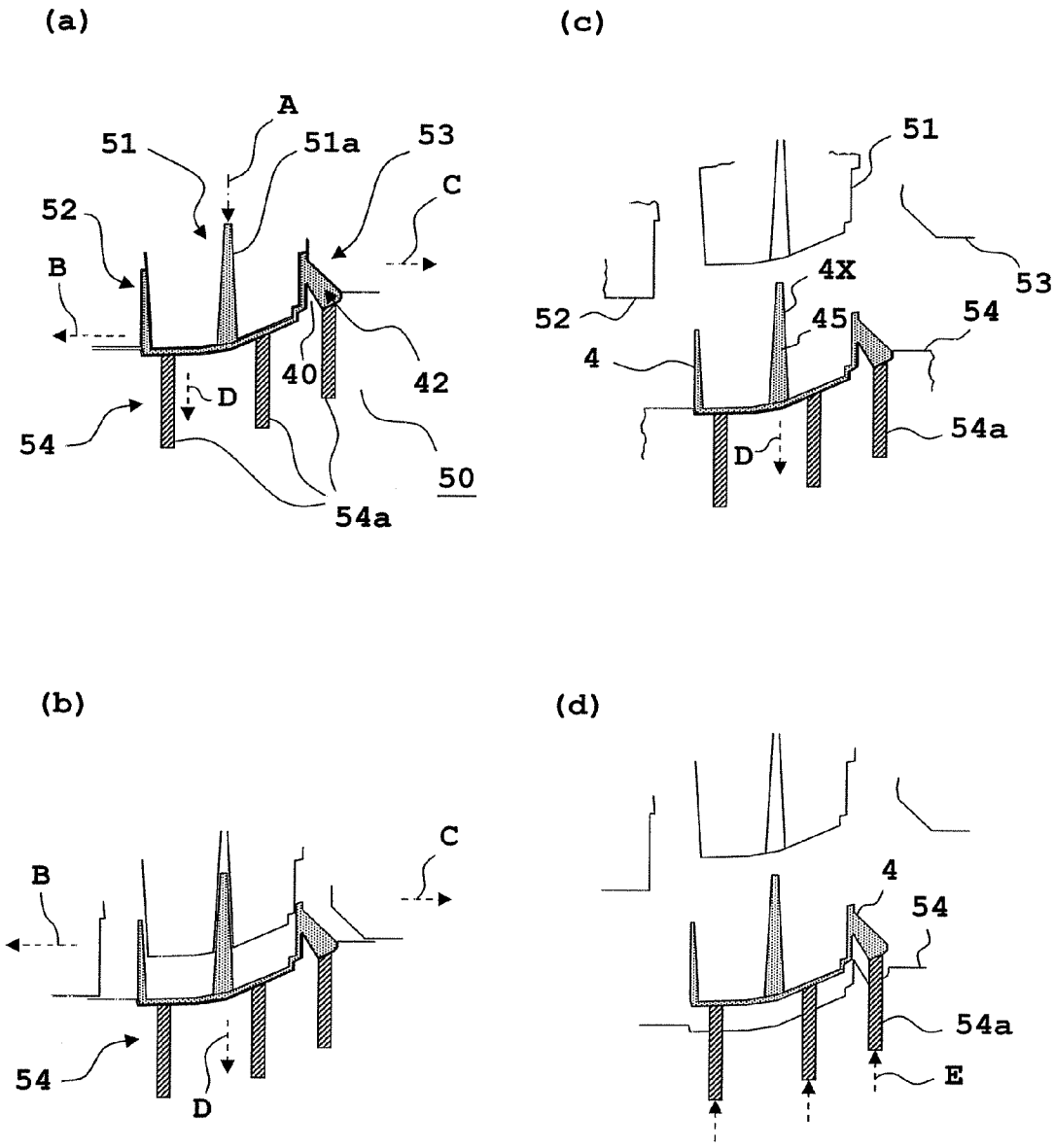
FIG. 7 are explanatory views each schematically illustrating operations in the case of injection molding of the drain pan integrated with a stabilizer for use in an indoor equipment of an air conditioner according to a second embodiment of the invention.
Figure 8:
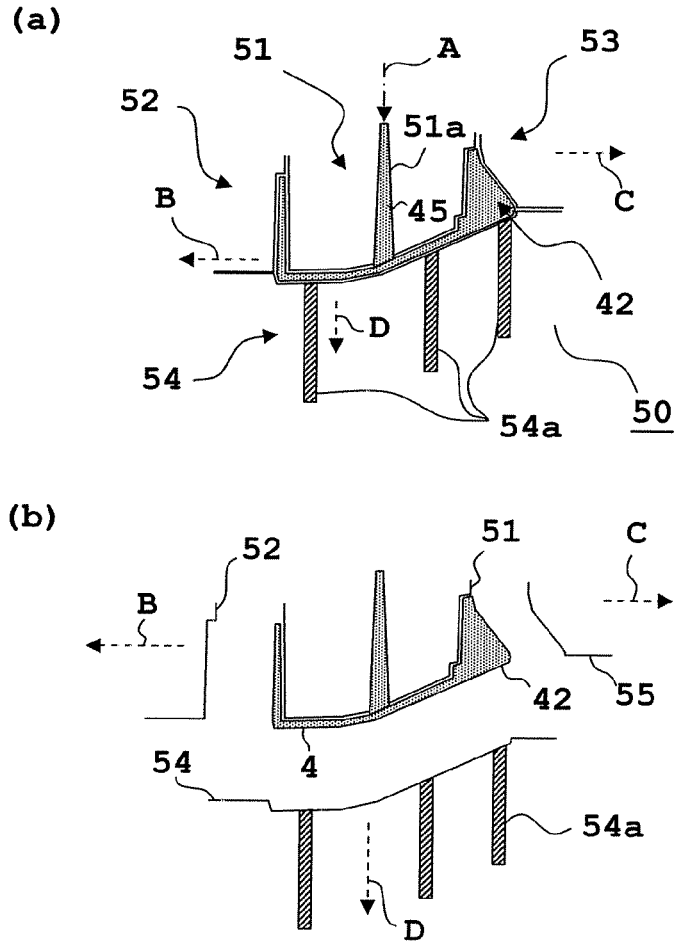
FIG. 8 are reference views each explaining operations in the case where there is no concave portion at the drain pan integrated with a stabilizer shown in FIG. 7.
Figure 9:
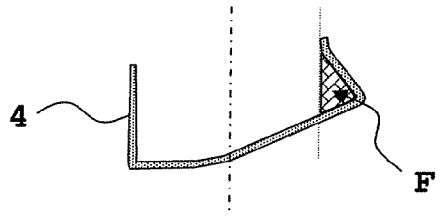
FIG. 9 is a reference view explaining the case where the stabilizer portion is formed to be in a uniform thickness shown in FIG. 7.

FIGS. 7 to 9 illustrate as a second embodiment an injection molding method of the drain pan 4 with an integrated stabilizer for use in the indoor equipment of the air conditioner according to the above-mentioned first embodiment. FIG. 7 are explanatory views schematically illustrating operations in the case of injection molding of the drain pan illustrated in FIG. 3; FIG. 8 are reference views explaining the operation in the case where there is no concave portion at the drain pan with an integrated stabilizer; and FIG. 9 is a reference view explaining the case where the stabilizer portion is formed to be in a uniform thickness. In the drawings, a die 50 consists of a fixed-side die 51 having a gate 51*a* for feeding a cast resin 45 in a direction indicated by the arrow A, a left slide die 52 and a right slide die 53 that are located at left and right of the die 51, and a moving die 54 that is provided below each of these dies 51, 52 and 53 and that has a plurality of protruding pins 54*a*. Incidentally, the arrows B, C and D illustrate respective moving directions when each of the dies 52, 53 and 54 are opened, and the arrow E illustrates a moving direction of the protruding pin 54*a*.

Now, the operation of the die 50 when the drain pan 4 is molded is described. The cast rein 45 is injected into the die 50 from the gate 51*a* that is provided substantially at the center of the fixed-side die 51. After filling the die 50 with the cast resin 45 has completed to be cooled and cured as illustrated in FIG. 7(*a*), then as illustrated in FIG. 7(*b*), while the left slide die 52 and the right slide die 53 are being opened in the directions indicated by the arrows B and C respectively, the moving die 54 is moved in the direction indicated by the arrow D. The drain pan 4 is separated from the fixed-side die 51 along with the moving die 54 as illustrated FIG. 7(*c*) without being separated from the moving die 54 due to the presence of a frictional resistance between the wall surface forming the concave portion 40 and the wall surface of the moving die 54. Thereafter, as illustrated in FIG. 7(*d*), the protruding pins 54*a* of the moving die 54 are protruded in a direction indicated by the arrow E, and the drain pan 4 is separated from the moving die 54 to take out the drain pan 4 as a product.

Incidentally, although shape or depth of the above-mentioned concave portion 40 is not particularly limited, the relationship between thicknesses of the peripheral members in the case of forming the concave portion 40 is described referring to FIG. 6(*c*) used in the above-mentioned first embodiment. Letting the bottom plate thickness of the drain pan body 41 t1, and letting the plate thickness in cross section in the vicinity of a bifurcated portion between the skirt portion 42*b* and the drain pan body 41 right above the tip end portion 40*a* of the concave portion when the depth d of the concave portion 40 is enlarged from the bottom face position of the drain pan body 41 t2, the depth d of the concave portion 40 is desired to be set to such a depth as follows:

$$t2(\text{mm}) \leqq t1(\text{mm})+2(\text{mm})$$

When the depth of the concave portion 40 is set in such a manner, a curvature deformation at the time of molding due to an uneven thickness of the drain pan 4 is suppressed, thus enabling to reduce a process defect.

Now, to describe the advantage brought by the above-mentioned concave portion 40, operations of the dies in the case of not being provided with the concave portion 40 is described referring to FIG. 8. The cast resin 45 is injected from the gate 51*a* that is provided substantially on the center of the fixed-side die 51. After filling the die 50 with the resin has completed to be cooled and cured, while the left slide die 52 and the right slide die 53 are being opened in the directions indicated by the arrows B and C respectively, the moving die 54 is moved in the direction indicated by the arrow D. Since there is no face at the drain pan 4 to generate a frictional force for being held by the moving die 54, the drain pan 4 remains on the fixed-side die 54 side as illustrated in FIG. 8(*b*), and thus cannot be taken out. In addition, in case of no concave portion 40, thickness of the stabilizer portion 42 comes to be extremely large, so that a molding cycle becomes long resulting in the reduction of productivity. To prevent this large thickness, in case where the shape in cross section of the drain pan 4 is formed to be in a uniform thickness, for example, as illustrated in FIG. 9, an F portion indicated by the diagonal lines in the drawing is formed into an undercut shape, and therefore any inside slide needs to be provided at the fixed-side die 51, resulting in disadvantages such as increase of die costs or longer molding cycle.

As described above, according to this second embodiment, due to that there is provided the concave portion 40 on the air flow path side in the vicinity of the boundary between the drain pan body 41 and the stabilizer portion 42, a mold release resistance required at the time of injection molding can be ensured, and thus a product can be prevented from being taken with the die, resulting in an improved productivity. Furthermore, since the depth d of the concave portion 40 is set to be within a predetermined range, the uneven thickness of the drain pan 4 can be suppressed, the curvature deformation at the time of molding of the drain pan 4 is suppressed, and thus the process defect can be reduced.

Embodiment 3

Figure 10:
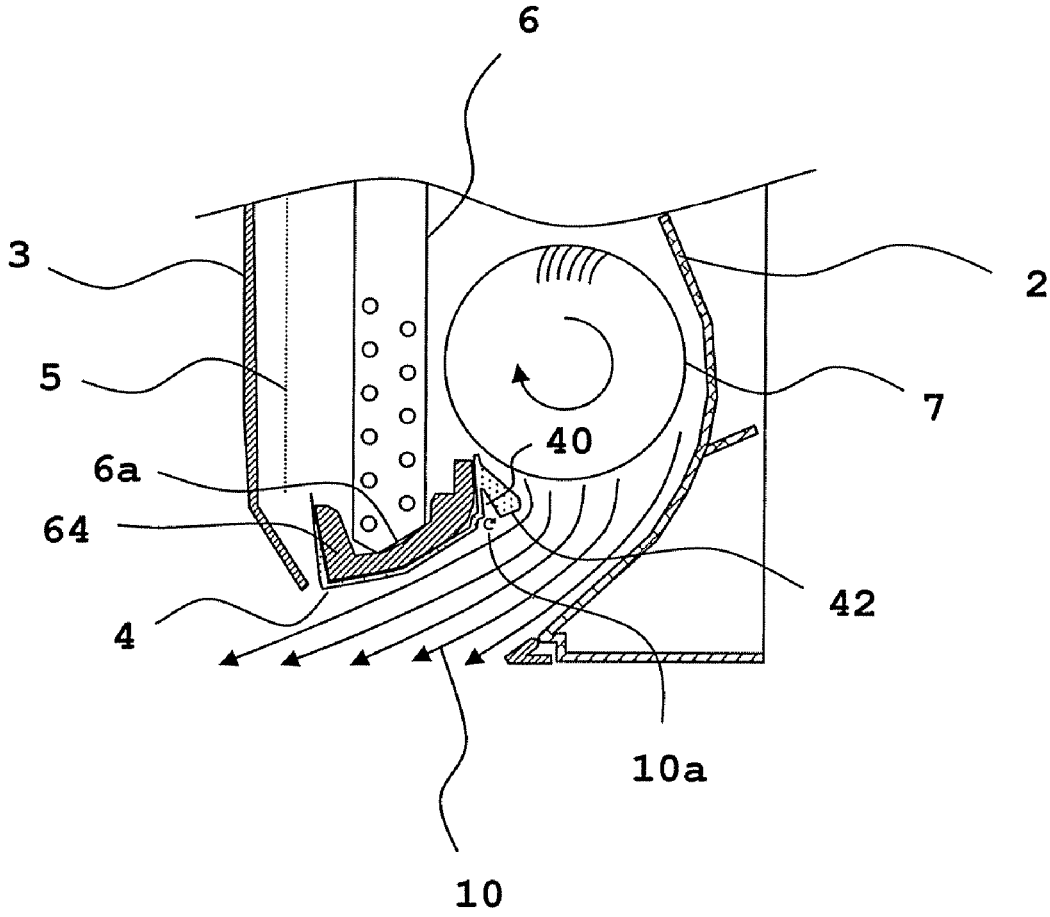
FIG. 10 is a sectional view illustrating an essential part of an indoor equipment of an air conditioner according to a third embodiment of the invention.

FIG. 10 is a sectional view illustrating an essential part of an indoor equipment of an air conditioner according to a third embodiment of the invention. In this third embodiment, a lower end portion 6*a* of the heat exchanger 6 is brought in close contact with the top face of the insulating member 43, and thus there is no gap between the insulating member 43 and the lower end portion 6*a* of the heat exchanger 6 as illustrated in the drawing. Incidentally, the illustration of wind direction control means is omitted. The other constructions are the same as in the above-mentioned first embodiment.

According to this third embodiment, as compared with the indoor equipment structure illustrated in FIG. 1, a leaked wind passing through the gap between the lower end portion 6*a* of the heat exchanger 6 and the insulating member 43 can be suppressed, so that substantially the amount of wind passing through the heat exchanger 6 is increased, thus enabling to obtain the advantage of an improved heat exchanging performance.

Embodiment 4

In this fourth embodiment, except that the material of the mentioned insulating member 43 of which illustration is omitted employs polystyrene of high impact resistance grade (high-impact polystyrene), polyethylene, polypropylene or copolymers thereof, the same indoor equipment as in the above-mentioned first embodiment is obtained (illustration is omitted). Incidentally, other than the change of the material, the fourth embodiment is the same as the first to third embodiments, so that description thereof will be made referring to FIG. 1.

According to this fourth embodiment, when each component member is integrated into the indoor equipment housing 1 illustrated in FIG. 1, due to superior impact resistance of the insulating member 43, the occurrence of crack or chip of the insulating member 43 due to the contact with the lower end portion 6*a* of the heat exchanger 6 can be suppressed, and thus the process defect can be reduced. Therefore, an advantage of improved production efficiency can be obtained. Incidentally, although the stabilizer portion 42 in the above-mentioned embodiments is described showing an example of configuration in which multiple fin members 42*a* are linearly aligned via the space portions 42*c*, it is not necessarily limited to this example. For instance, with the one of a plate even in a lateral direction viewed in the direction of the air outlet 9 (from the front) equipped with no fin members, the same advantage can be expected. In addition, it is a matter of course that the shape of the fin members 42*a*, the molding method or the like can be modified or varied within the spirit of the invention.

Various modifications and alterations of the invention will become apparent to those skilled in the art without departing from the scope and spirit of the invention, and it should be understood that the invention is not to be unduly limited to the illustrative embodiments set forth herein.

The invention claimed is:

1. An indoor equipment of an air conditioner in which a heat exchanger, a blower, and a drain pan for receiving a drain water having been condensed at said heat exchanger is contained in an internal part of an indoor equipment housing, said housing including an air inlet and an air outlet; and a back portion of said drain pan faces an air flow path communicating with said air outlet, and a stabilizer is disposed at an end portion on an upstream side of the air flow path of said drain pan; wherein the indoor equipment of the air conditioner comprises an integrally injected molded drain pan including a drain pan body, a stabilizer portion, and a concave portion exposed to the air flow path in the vicinity of the boundary between said drain pan body and said stabilizer portion, wherein the stabilizer portion has a variable thickness and wherein t1 is a bottom plate thickness of said drain pan body, and t2 is a plate thickness in cross section in the vicinity of a bifurcated portion between said stabilizer portion and said drain pan body right above a tip end portion of said concave portion when a depth d of said concave portion is enlarged from a bottom face position of said drain pan body, and wherein the depth d of said concave portion is set such that:

$$t2(\text{mm}) \leqq t1(\text{mm})+2(\text{mm}).$$

2. The indoor equipment of the air conditioner according to claim 1, wherein a face for receiving said drain water of said drain pan body and a lower end portion of said heat exchanger are in contact with one another.

3. The indoor equipment of the air conditioner according to claim 1, wherein said concave portion is a mold release resistant element at the time of mold release in injection molding.

4. The indoor equipment of the air conditioner according to claim 1, wherein an insulating member that is made of polystyrene of high impact resistant grade (high-impact polystyrene), polyethylene, polypropylene or copolymers thereof is provided at a top face of said drain pan body.

* * * * *